US005114394A

United States Patent [19]

Madsen

[11] Patent Number: 5,114,394

[45] Date of Patent: May 19, 1992

[54] PUNCHING ATTACHMENT FOR BAG MAKING MACHINE

[76] Inventor: Dale R. Madsen, 2392 Taylor Rd., Savannah, N.Y. 13146

[21] Appl. No.: 583,472

[22] Filed: Sep. 17, 1990

[51] Int. Cl.[5] ..... B31B 23/14; B26D 7/02; B26D 9/00; B26D 5/12

[52] U.S. Cl. ..... 493/227; 83/387; 83/620; 83/639.1

[58] Field of Search ..... 83/618, 620, 639.1, 83/385, 386, 387; 493/227

[56] References Cited

U.S. PATENT DOCUMENTS

| | | | |
|---|---|---|---|
| 152,862 | 7/1874 | Perkins | 83/387 |
| 703,183 | 6/1902 | Chapin | 83/387 |
| 1,817,428 | 8/1931 | Takamatsu | 83/387 |
| 1,854,516 | 4/1932 | Kirchner | 83/387 |
| 2,643,715 | 6/1953 | McClellan | 83/387 |
| 3,368,441 | 2/1968 | Piazze | 83/682 |
| 3,802,308 | 4/1974 | Davis | 493/203 |
| 3,992,966 | 11/1976 | D'Agostino | 83/386 |
| 4,377,097 | 3/1983 | Calvano | 83/387 |
| 4,488,466 | 12/1984 | Jones | 83/386 |

*Primary Examiner*—William E. Terrell

*Attorney, Agent, or Firm*—Shlesinger, Fitzsimmons & Shlesinger

[57] ABSTRACT

A single, fluid pressure-operated cylinder, which has a conventional slitter blade and punch releasably secured to the lower end of its piston rod, is secured to a plastic bag making machine so that the operating ends of the blade and punch project toward a stationary, horizontal support surface across which overlapping plastic webs pass during bag manufacturing. The webs are secured against movement during a slitting and punching operation by a pressure plate, which is also mounted on the piston rod for movement thereby into engagement with the plastic webs to clamp them against the stationary support surface during the initial advance of the rod. As the rod continues to advance it moves the blade and punch through the now-clamped plastic webs, after which the piston rod is retracted and the parts return to their inoperative positions.

12 Claims, 3 Drawing Sheets

PUNCHING ATTACHMENT FOR BAG MAKING MACHINE

BACKGROUND OF THE INVENTION

This invention relates to machines for making plastic bags, and more particularly to improved means for mounting a bag punching and slitting device on such machines. Even more particularly this invention relates to improved means of the type described which utilizes a single fluid pressure-operated cylinder for simultaneously gripping, punching and slitting plastic bags made on a machine of the type described.

In machines of the type described for manufacturing plastic bags, overlapping webs of thermoplastic material are passed beneath one or more punching and slitting devices, which function simultaneously to form adjacent slits and circular openings or perforations into what is to be the open end of a respective bag. For example, in my co-pending U.S. patent application Ser. No. 07/529,646, which was filed May 29, 1990, and which issued on Jul. 30, 1991 as U.S. Pat. No. 5,035,165, I have disclosed a combination punching and slitting device which is adapted to be mounted on a machine of the type described for operation by a fluid pressure-operated cylinder, such as for example a compressed air cylinder. Heretofore in a machine of this type it has been customary to use one fluid pressure-operated cylinder for simultaneously reciprocating the punch and blade device toward and away from the overlapping plastic webs, and a separate fluid pressure-operated cylinder for manipulating a gripping device which holds the overlapping webs in a stationary position during the bag punching and slitting operation.

FIG. 2 of the U.S. Pat. No. 3,802,308, for example, illustrates a first fluid pressure-operated cylinder 52 that is used, among other things, to reciprocate a pair of web retainers which grip and hold in place a pair of overlapping, plastic sheets or webs, at the same time that a second such cylinder (88) reciprocates a combination punching and slitting device toward and away from the now-gripped webs.

A primary disadvantage of prior such web gripping and punching/slitting mechanisms is that at least two separate fluid pressure-operated cylinders are required to operate, respectively, the web gripping members, and the punching/slitting device. In addition to the increased costs required by duplicating the fluid pressure-operated cylinders, there is also the care and control that must be exercised in order to assure that the respective cylinders and associated mechanisms are operated in proper sequence. The need for carefully gripping and holding plastic sheets or films as they are being punched and slit is particularly important in the case of very thin films or plastic sheets, which otherwise exhibit undesirable stretching of the film or sheet around the hole which is punched. It is essential also that tough, high density plastic materials also be carefully clamped during the punching operation to achieve maximum punch and blade life.

It is an object of this invention, therefore, to provide an improved bag punching and slitting device that incorporates therein a web gripping device, and which utilizes a single, fluid pressure-operated cylinder for operating both the punch/slitter device and the associated web gripping mechanism.

Still another object of this invention is to provide an improved bag punching and slitting mechanism which, immediately upon operation of the associated bag punching and slitting device, operatively grips and holds the overlapping webs or films that are to be punched and slit.

A further object of this invention is to provide a combined punch/slitter and web gripping mechanism of the type described which can be quickly mounted upon or removed from an associated bag making machine to effect adjustment or replacement thereof.

Other objects of the invention will be apparent hereinafter from the specification and from the recital of the appended claims, particularly when read in conjunction with the accompanying drawings.

SUMMARY OF THE INVENTION

A single fluid pressure operated cylinder is adjustably and removably secured upright on one horizontal leg of a right angular bracket, which is releasably secured to a support plate at one side of a plastic bag making machine. The cylinder's piston rod extends downwardly through a slot in the bracket leg, and through the center of a horizontal support plate or platform which is secured to the piston rod for vertical reciprocation thereby. A conventional slitter blade and punch are releasably secured side-by-side by a clamp to the lower end of the piston rod, and project downwardly therefrom toward a stationary, horizontal pressure plate across which overlapping plastic webs pass during bag manufacturing.

To secure the webs against movement during a slitting and punching operation, a movable pressure plate is suspended resiliently from the platform between the stationary pressure plate and the blade and punch. Both the movable and stationary pressure plates have therethrough openings which register with the blade and punch to permit those items to pass downwardly through such openings during a punching and slitting operation.

In use, fluid under pressure is supplied intermittently to the cylinder, thereby intermittently to cause its piston rod to reciprocate downwardly from a retracted to an advanced position. During the initial advance of the rod, and corresponding initial downward movement of the attached platform, the upper pressure plate is moved thereby into clamping engagement with the plastic webs then overlying the stationary pressure plate. As the platform continues to move downwardly the blade and punch pass through the now-clamped plastic webs at the same time that resilient springs between the platform and upper pressure plate permit the former to move downwardly relative to the latter. Thereafter, when the piston rod is retracted, the parts return to their inoperative positions.

THE DRAWINGS

Figure 3:
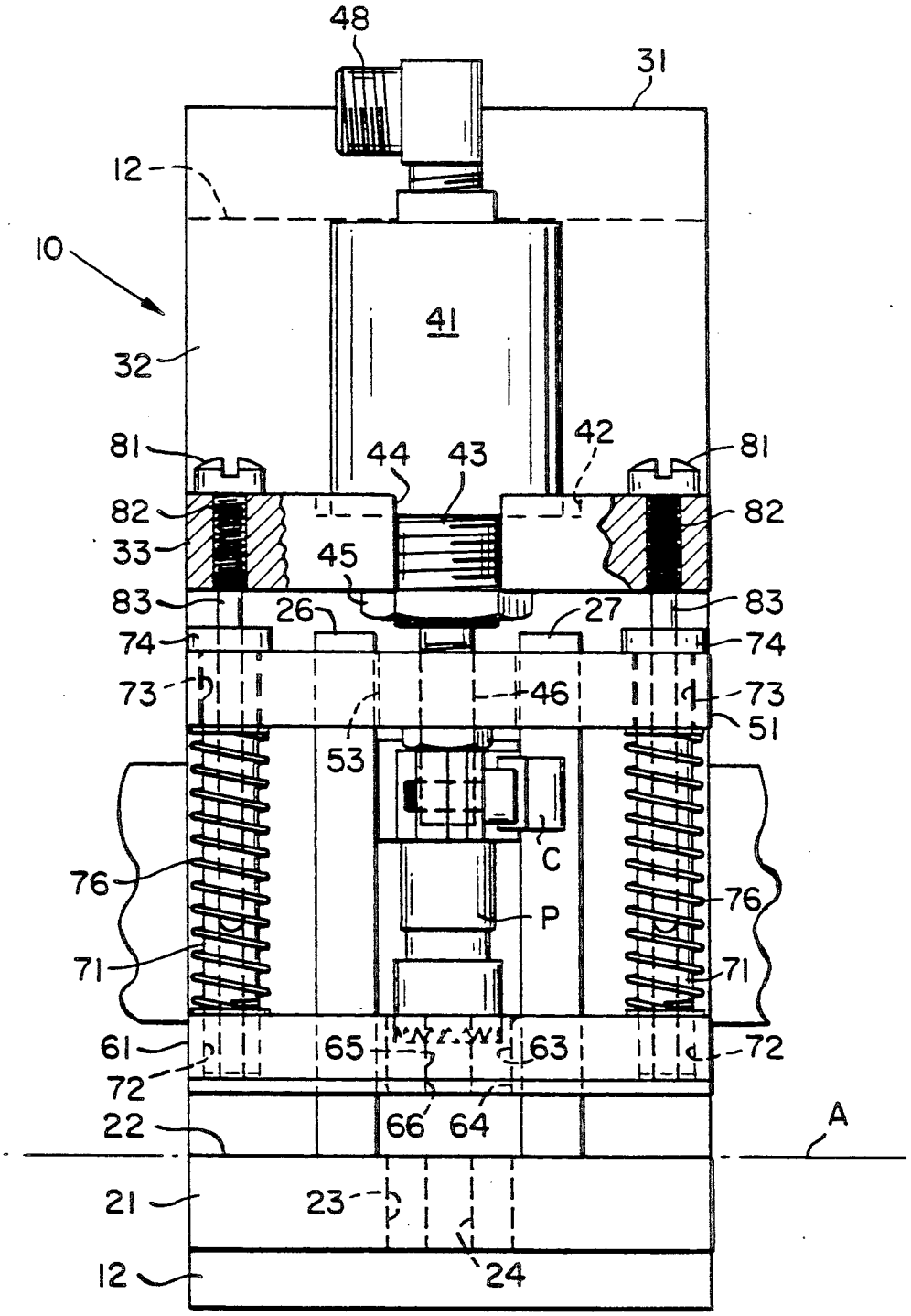

FIG. 3. is a front elevational view of this device; and

Figure 4:
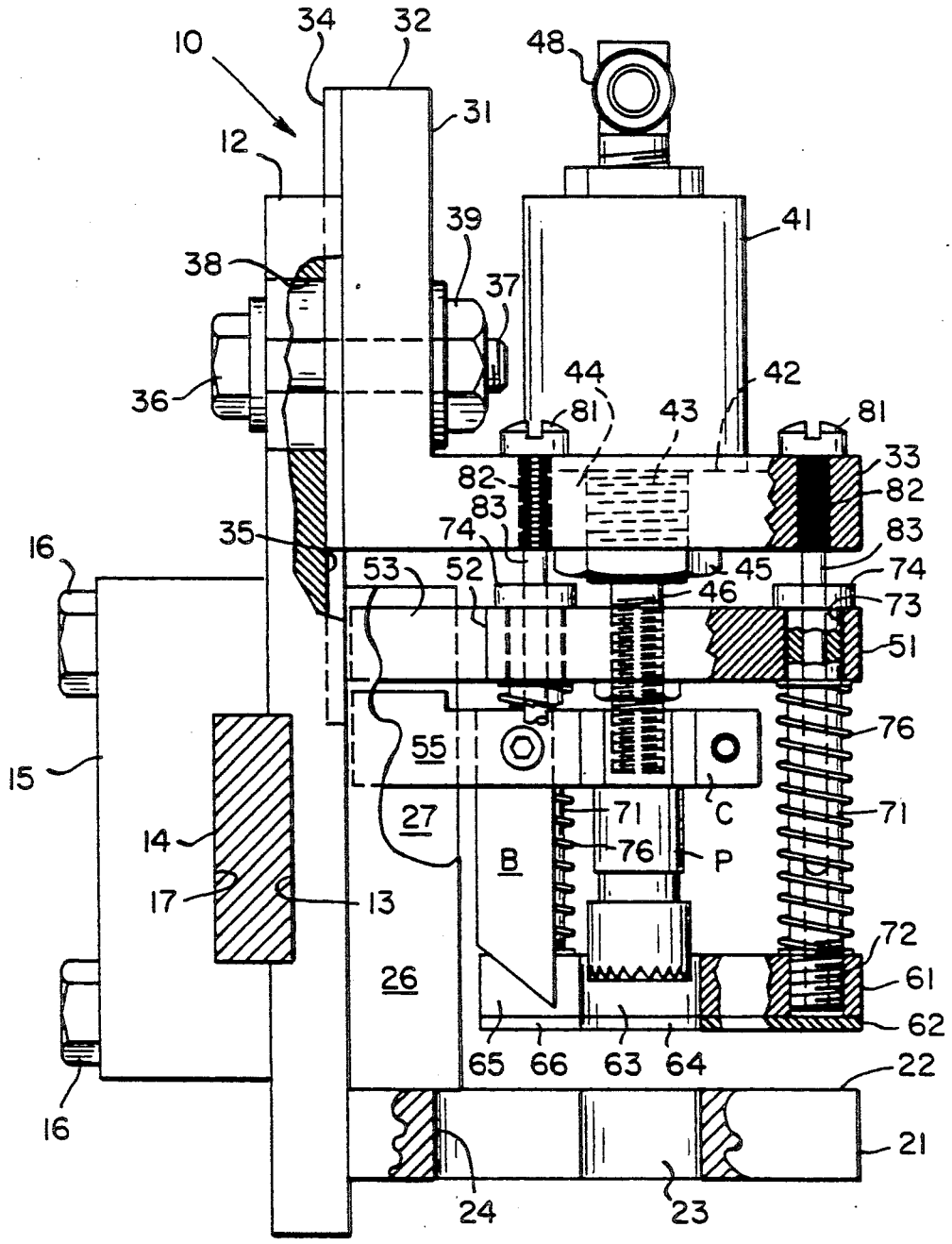

FIG. 4. is a side elevational view of this device as seen when looking at the left side of FIG. 3 and with portions thereof being broken away and shown in section.

DETAILED DESCRIPTION OF THE PREFERRED EMBODIMENTS

Referring now to the drawings by numerals of reference, 10 denotes generally a combined bag gripping, punching and slitting device comprising a rectangularly shaped back plate or support 12 having in its rear or left hand surface, as shown in FIG. 4, a rectangular, transversely extending notch or recess 13 for accommodating one part of a horizontally disposed mounting bar 14, which forms an integral part of the bag making machine upon which the device 10 is disposed to be mounted. The back plate or support 12 is secured firmly on the machine mounting bar 14 by a large, rectangularly shaped clamping plate 15, which is removably secured by bolts 16 to the plate 12, and in such a manner that the machine mounting bar 14 projects into, or seats snugly within, a notch or recess 17 formed on the inside face of the clamping plate 15.

Figure 2:
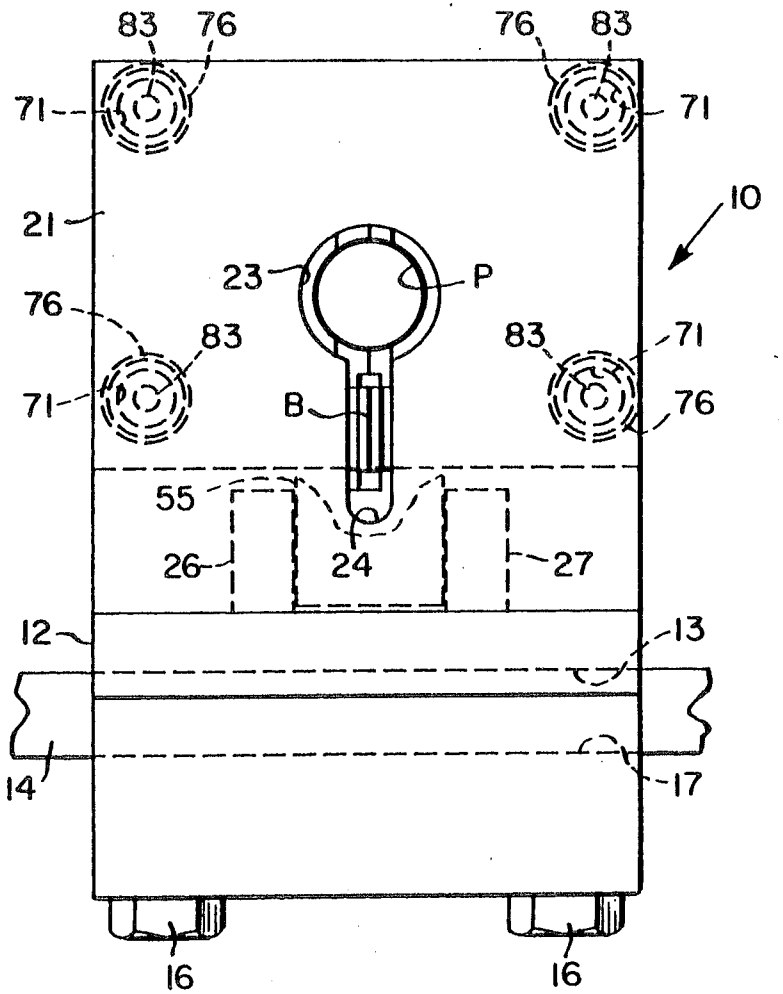
FIG. 2 is a bottom plan view of this device.

Integral with and projecting from the forward face (the right hand face as shown in FIG. 4) of the mounting plate 12 adjacent the lower edge thereof is a rectangularly shaped, stationary pressure plate 21. Plate 21 has a plane, flat upper surface 22, which is disposed in a substantially horizontal plane when the plate 12 is properly mounted on the bar 14, and across which surface overlapping webs of thermoplastic bag making material are adapated to pass when the associated bagging machine is placed in operation. Plate 21 has therethrough substantially centrally thereof a vertically disposed, circular opening 23 which at one diametral side thereof (the lower side in FIG. 2 and the left side in FIG. 4) communicates with a blade accommodating notch or slot 24, which projects radially away from the opening toward support plate 12 for a purpose noted hereinafter.

Secured to the inside or forward face of the support plate 12, and projecting vertically upwardly from the upper surface 22 of the pressure plate 21 in spaced, parallel relation to each other are two rectangularly shaped guide bars or lands 26 and 27. As shown more clearly in FIGS. 3 and 4, lands 26 and 27 extend equidistantly above pressure plate 21, and only part way up the inner face of support plate 12. The laterally spaced, plane, confronting surfaces on the lands 26 and 27 are used for guiding purposes, as noted hereinafter.

Figure 1:
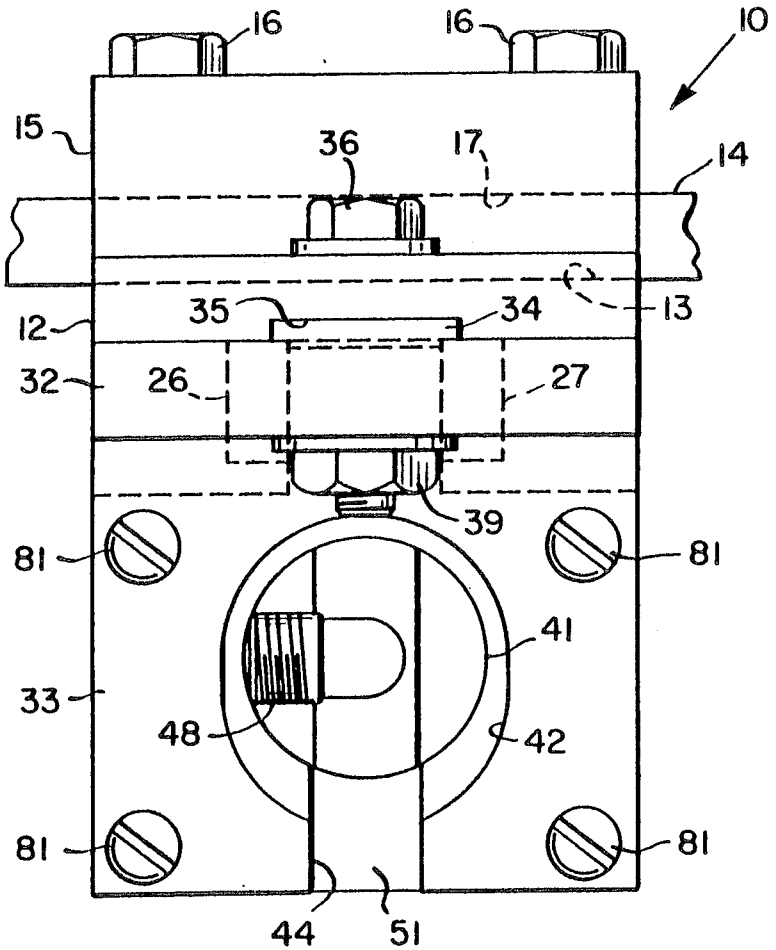
FIG. 1 is a plan view of a combined bag gripping, punching and slitting device made according to one embodiment of this invention, a portion of the machine upon which the device is mounted being out away and shown fragmentarily.

Adjustably secured to the inside face or surface of the support plate 12 above the upper ends of the lands 26 and 27 is a right angular mounting bracket 31. Bracket 31 includes a vertically disposed leg section 32, and a horizontally disposed leg section 33 which projects at right angles from leg 32 outwardly over and above the pressure plate 21 in spaced, parallel reaction thereto. In its rear or left hand face as shown in FIG. 4, the bracket leg 32 has formed thereon a vertically disposed, centrally located rib 34 (FIGS. 1 and 4), which is slidably or adjustably seated in a complimentary groove or way 35 (FIG. 4) which is formed in the inside face of the support plate 12 adjacent the upper end thereof. Bracket leg 32 is adjustably secured to the support plate 12 by a bolt 36 having a reduced-diameter shank 37, which extends through a vertical slot 38 in plate 12, and a registering, circular opening in the bracket leg 32. The large-diameter head of bolt 36 engages the outer surface of plate 12, while the nut 39 and washer combination which is fastened to the opposite end of bolt 36 engages the outer or right hand face of the bracket leg 32 as shown in FIG. 4. With this construction the bracket 31 can be adjusted vertically by loosening the nut 39, thereby permitting bracket 31 to be shifted vertically to the extent permitted by the slot 38 in the support plate 12. All such vertical motion be guided by the rib 34, which slides in the way 35.

Secured at its lower end to the horizontal bracket leg 33 substantially centrally thereof is a conventional fluid pressure-operated cylinder 41, which, by way of example, can be a compressed air-operated cylinder or the like. Cylinder 41 is circular in cross section, and is seated at its lower end adjustably in a generally oval shaped recess 42 that is formed in the upper surface of the bracket leg 33 centrally thereof. Cylinder 41 has on its lower end a reduced-diameter, externally threaded shank 43, which extends downwardly through a central slot or notch 44, which opens at its outer end on the outer or right hand edge of the bracket leg 33, and which has spaced, parallel side walls separated from one another a distance only slightly greater than the diameter of the shank section 43 of the cylinder. Cylinder 41 is adjustably secured on the bracket leg 33 by a nut 45, which is threaded onto the lower end of the threaded section 43 of the cylinder 41 to engage the underside of leg 33. By backing off the nut 45, the position of the cylinder 41 on bracket leg 33 can be adjusted longitudinally of the slot 44 and recess 42 for purposes noted hereinafter.

The cylinder 41 includes the usual piston rod 46 (FIGS. 3 and 4), the lower end of which projects beyond the lower end of the externally threaded section 43, and which as shown in FIG. 4 is also externally threaded. Intermediate its ends the externally threaded portion of rod 46 is threadably secured in a central opening formed in a generally rectangularly shaped, vertically reciprocable plate or platform 51, which has projecting centrally from its rear edge 52 (FIG. 4) a rectangularly shaped guide tongue or projection 53 that extends slidably into the space between the ways 26 and 27. Rod 46 extends at its lower end beneath platform 51 and has releasably fastened thereon a combined bag punching and slitting device of the type which is disclosed in my above-noted copending application Ser. No. 07/529,646. This device includes a cylindrically shaped punch P, and a thin, bag-slitting blade B, which are secured at their upper ends in a holder device or clamp C that may be of the type disclosed in my said application Ser No. 07/529,646, and which is releasably attached to the lower end of the piston rod 46 to be reciprocated vertically thereby as noted hereinafter. Since the clamp C is disclosed in detail in my above-noted copending application, it will not be described in greater detail herein; but to the extent that it might be necessary for a better understanding of such device, the subject matter of my copending application Ser. No. 07/529,646 is incorporated herein by reference.

As shown in the accompanying drawings, the clamp C supports the punch P vertically and in registry with the circular opening 23 in the lower pressure plate 21, and in spaced, side-by-side relation to the blade B, which also is supported by the clamp C so that the lower, cutting edge of the blade B registers with the slot 24 in plate 21. Clamp C has projecting from the rear or left end thereof a rectangularly shaped tongue or projection 55, which extends into the space between the lands 26 and 27 to be guided slidably therebetween for vertical motion when the piston rod 46 is reciprocated, as noted hereinafter. Like the projection 53 on the platform 51, the projection 55 on the clamp C stabilizes the clamp C to prevent any undesirable pivotal movement thereof about a vertical axis when punch P and blade B are reciprocated vertically by the piston rod 46.

Suspended beneath and registering with the generally rectangularly shaped platform 51 is a rectangular, upper pressure plate 61, which, unlike platform 51, does not have a guide tongue (such as 53) projecting from its rear edge. Secured to the plane, underside of plate 61 is a thin, resilient layer 62 of plastic or rubber, which is disposed to be urged resiliently against the upper surface 22 on the stationary or lower pressure plate 21, when the mechanism is operated as noted hereinafter. Plate 61 and its resilient pad 62 have therethrough registering, coaxial, vertical openings 63 and 64 which are disposed coaxially of the opening 23 in the lower pressure plate 21, and coaxially also of the punch P, the lower end of which normally projects slightly to the upper end of the opening 63 in plate 61. At one diametral side thereof the openings 63 and 64 register with the inner ends of vertically registering slots 65 and 66, respectively, which extend between the inner edge of the plate 61 and openings 63 and 64. As shown more clearly in FIG. 4, the slots 65 and 66 register vertically with the slot 24 in the lower pressure plate 21, and with the lower end of the blade B, which normally projects slightly into the upper end of the slot 65 in plate 61.

The plate 61 is suspended resiliently and in spaced, parallel relation beneath the upper platform 51 by four, spaced, parallel, vertically disposed tubular members 71, which may be in the form of axially drilled bolts that are adjustably threaded as at 72 at their lower ends in openings which are formed through the plate 61 adjacent each of its four corners. Adjacent their upper ends bolts 71 extend slidably through registering circular openings 73, which are formed in the platform 51 adjacent each of its four corners. The axially bored head 74 on the upper end of each tubular member 74 overlies and is releasably engagable with the upper surface of the platform 51 to limit the extent to which the tubular members 71 can slide downwardly relative to platform 51. Also, each of the tubular members 71 is surrounded between the plates 51 and 61 by a coiled compression spring 76, which springs resiliently resist movement of the pressure plate 61 upwardly relative to the platform 51, and operate normally to retain the plate 61 in the position of rest as illustrated in FIGS. 3 and 4. The four tubular members 71 and their axially bored heads 74 thus function resiliently to suspend the upper pressure plate 61 from the platform 51, and in spaced, parallel relation therewith.

To guide both of the plates 51 and 61 for vertical movement, four elongate guide screws 81 are threadably secured adjacent their upper ends as at 82 (FIGS. 3 and 4) in four, internally threaded openings which are formed through the bracket leg 33 to register vertically with the bores in the tubular members 71 and their associated heads 74. Each of the guide screws 81 has a reduced-diameter, smooth shank portion 83, which projects downwardly beneath the bracket leg 33, and slidably through the registering head 74 and into the bore in the associated tubular member 71. The rigid shanks 83 of the screws 81 thus guide both the upper and lower plates 51 and 61 for vertical reciprocation as noted hereinafter.

In use, overlapping portions or layers of the plastic webs or films, which are employed to manufacture bags on machines of the type described, are fed through the associated machine in such manner that they travel in the plane A, as represented by the broken line in FIG. 3, across the upper surface 22 of the lower pressure plate 21, and in a direction parallel to the machine mounting bar 14. By a mechanism not illustrated, and which forms no part of this invention, a pressurized fluid, such as air or the like, is intermittently supplied to cylinder 41 via a mechanism that can be threaded onto the fitting 48 located at the upper, inlet end of cylinder 41.

Whenever fluid under pressure enters cylinder 41, its piston rod 46 urges the plates 51 and 61 downwardly relative to the bracket leg 33, thus causing the resilient pad 62 on the lower side of the pressure plate 61 to engage and clamp the overlapping plastic webs, which are to be punched and slit, against the upper surface 22 of the stationary, lower pressure plate 21. During this initial movement of the piston rod 46 the two plates 51 and 61 move in unison, at least until such time that the pad 62 clamps the plastic webs against the lower pressure plate 21. After this clamping has occurred, the piston rod 46 continues to advance further downwardly, and in so doing begins to compress the springs 76, by virtue of the fact that the plate 51, which is secured to the piston rod 46, continues to move downwardly after further downward movement of the pressure plate 61 has been prevented by its engagement with pressure plate 21. During the subsequent downward movement of the piston rod 46 the clamp C, which carries the blade B and punch P, continues its downward movement relative to the now-stationary plate 61, and as a consequence, as the tension in the springs 76 increases, lower ends of the punch P and blade B move downwardly relative to plate 61 and into the registering openings 23 and 24, respectively, in the lower pressure plate 21, during which movement the punch P punches a circular hole in the now-clamped plastic webs at the same time that the blade B slits the webs adjacent the opening formed by the punch P.

As soon as the pressure in cylinder 41 is reduced or released, the piston rod 46 begins to retract into the cylinder 41, and in so doing elevates the upper plate 51 and the attached clamp C upwardly toward their inoperative positions as shown in FIGS. 3 and 4. During the initial part of this return movement the compression springs 76 cause the upper plate 51 to be moved vertically relative to the lower plate 61, until such time that the upper platform 51 engages the undersides of the annular caps 74 on the tubular members 71, after which further upward movement of the piston rod 46 will cause the plates 51 and 61 to be elevated in unison back to their inoperative positions.

It will be apparent that this above-described punching and slitting operation is performed intermittently and rapidly; and during each such operation the overlapping webs, which are to be punched and slit, will first be clamped securely by the pad 62 against the upper surface of the lower pressure plate 21 before the punch P and blade B strike the plastic webs. Thus the webs are firmly held in a stationary position during the actual punching and slitting operations. Moreover, it will be apparent that the initial clamping operation and the subsequent punching and slitting operation are all effected by operation of a single pressure-operated cylinder 41. Moreover, during such operations the stationary guide pins or screw shanks 83, in combination with the projections 53 and 55 on the upper plate 51 and the clamp C, function carefully to guide the reciprocating parts, so that the overlapping plastic webs will be very accurately punched and slit time after time during operation of the equipment.

Still another advantage of this constructions is that the mechanism is designed so that simply by removing the nut 39 and associated bolt 36, the entire front assembly, which constitutes the bracket 31 and the clamping, punching and slitting devices mounted thereon, can be removed quickly and easily whenever it is desired to replace a blade B or punch P. If the fitting 48 is connected by a flexible hose or line to a supply of fluid under pressure, it will not even be necessary to disconnect the fitting 48 from the supply, assuming that a valve is interposed between fitting 48 and the supply for cutting off the pressure when it is desired to remove the assembly. Also, simply by releasing the nut 45 the cylinder 41 can be adjusted longitudinally in the slot 44 in the bracket leg 33 in order accurately to register the associated punch P and blade B with the stationary, lower pressure plate 22. Moreover, by making the tubular members 71 so that they are adjustably threaded at their lower ends into openings in plates 61, it is possible to adjust the tension in the springs 76, and at the same time the space which normally separates the upper and lower plates 51 and 61. Moreover, as noted above, since bracket 31 can be removed from the support plate 12 to effect the change or replacement of the punch and cutting blade, it will be apparent that the proper adjustments of the punch and cutting blade can be made, relative to the bracket 31, before replacing the bracket 31 back onto the support plate 12 at the machine.

From the foregoing it will be apparent that the present inventions provides a relatively simple and inexpensive means for considerably reducing the mechanisms heretofore required for effecting a combined punching and slitting operation of the type described on plastic bag making machines. The improved mechanism not only is more compact, but also obviates the need for utilizing separate fluid pressure-operated cylinders for the web clamping operation, and the punching/slitting operation, respectively. Moreover, although this application has been illustrated and described in detail in connection with only certain embodiments thereof, it will be apparent that this invention is capable of still further modification, and that this application is intended to cover any such modifications as may fall within the scope of one skilled in the art, or the appended claims.

I claim:

1. A web clamping, slitting and punching device for plastic bag making machines of the type having a stationary web supporting surface across which each of two overlapping webs of plastic, bag-making film travel during the manufacture of bags on said machine, comprising a first bracket disposed to be removably fixed to said machine adjacent one side thereof, a second bracket removably mounted for vertical adjustment on said first bracket and having thereon a lateral projection disposed to overlie said stationary web supporting surface, a fluid pressure-operated cylinder having a reciprocable piston rod projecting from one end thereof, and disposed to be connected to a supply of fluid under pressure operative intermittently to reciprocate said rod between retracted and advanced positions, respectively, means releasably mounting said cylinder on said lateral projection on said second bracket with one end of said piston rod extending downwardly beneath said lateral projection, means removably mounting a slitting blade and a hole punch on said one end of said rod for reciprocation by said rod between retracted positions in which the operating ends of said blade and punch are disposed in spaced, confronting relation to said stationary web supporting surface and the webs passing thereover, and advanced positions in which said operating ends of said blade and punch engage and pass through said webs and into registering opening in said stationary web supporting surface, and web clamping means resiliently supported on said one end of said rod adjacent said blade and punch and having thereon a clamping surface overlying said web supporting surface normally to be spaced therefrom when said rod is in its retracted position, said web clamping means being operative upon the initial movement of said rod from its retracted to its advanced position to urge said clamping surface toward said stationary web supporting surface to engage and operatively clamp said plastic webs against movement on said stationary surface before said operating ends of said blade and punch engage said webs, and said blade and punch mounting means being operative to urge said operating ends of said blade and punch through said webs during the remaining movement of said rod to its advanced position.

2. A web clamping, slitting and punching device as defined in claim 1, wherein said means releasably mounting said cylinder on said lateral projection includes means for releasably adjusting said cylinder into different positions on said lateral projection, thereby to adjust the axis of said piston rod, and the slitting blade and punch thereon, laterally relative to said web supporting surface.

3. A web clamping, slitting and punching device as defined in claim 1, wherein said first bracket has thereon a web supporting projection which extends inwardly of said machine beneath said projection on said second bracket, and has thereon a plane, horizontal upper surface defining said web supporting surface.

4. A web clamping, slitting and punching device as defined in claim 1, wherein said web clamping means comprises a clamping plate supported for limited reciprocable movement on said lateral projection on said second bracket and having on the underside thereof said clamping surface, and resilient means interposed between said clamping plate and said lateral projection on said second bracket and operative resiliently to resist movement of said clamping plate relative to said lateral projection upon movement of said rod to its advanced position.

5. A web clamping, slitting and punching device as defined in claim 4, including guide means interposed between said clamping plate and said lateral projection on said second bracket and operative to guide said clamping plate for reciprocable movement relative to said lateral projection upon reciprocation of said piston rod.

6. A web clamping, slitting and punching device as defined in claim 1, including means defining in said device adjacent said first bracket a vertical guide slot which extends upwardly from said web supporting surface toward said lateral projection on said second bracket, and a rigid projection extending laterally from said mounting means for said slitting blade and punch and slidably into said guide slot to prevent rotation of said slitting blade and punch relative to the axis of said piston rod during reciprocation of said rod.

7. In a plastic bag making machine of the type having a stationary web supporting surface across which each of two overlapping webs of plastic, bag making film travel and a fluid pressure-operated web punching and slitting device, said surface having therein a pair of adjacent apertures beneath said device for accommodating the operating ends of, respectively, a web slitting blade and a web hole punch which form part of said device, the improvement wherein said device comprises a bracket having thereon a lateral projection, means releasably securing said bracket on said machine for vertical adjustment relative to said web supporting surface, and to support said lateral projection in spaced, confronting relation to said web supporting surface, means releasably securing a fluid pressure-operated cylinder over an opening in said lateral projection, said cylinder having a reciprocable piston rod which extends at one end thereof through said opening and toward said web supporting surface, means resiliently mounting a pressure plate on said one end of said piston rod for reciprocation thereby into and out of clamping engagement with the webs supported on said support surface, said pressure plate having therethrough a pair of adjacent apertures registering with and similar in configuration to said pair of apertures in said web supporting surface, and means releasably securing said web slitting blade and said web hole punch on said piston rod with the operating ends thereof registering with the respective apertures in said web supporting surface and said pressure plate, and operative upon each reciprocation of said piston rod to force the operating ends of said blade and punch through the overlapping webs on said web supporting surface after the webs have been clamped against said surface by said pressure plate.

8. In a plastic bag making machine of the type defined in claim 7, wherein said means mounting said pressure plate on said one end of said piston rod comprises a second plate secured to said one end of said piston rod between said pressure plate and said lateral projection on said bracket, means supporting said pressure plate on said second plate for limited reciprocable movement relative to said second plate during reciprocation of said piston rod, and resilient means interposed between said plates and operative to urge said pressure plate resiliently against said overlapping webs on said web supporting surface each time said piston rod moves from a retracted to an advanced position relative to said cylinder.

9. In a plastic bag making machine of the type defined in claim 8, wherein said means supporting said pressure plate on said second plate comprises a plurality of spaced, parallel rods each secured at one end to one of said plates and extending slidably adjacent its opposite end through a registering opening in the other of said plates, and said resilient means comprises a plurality of coiled compression springs surrounding at least certain of said rods and engaged at opposite ends thereof with said plates.

10. In a plastic bag making machine of the type described in claim 9, wherein said parallel rods are tubular and have the bores thereof extending parallel to the axis of said piston rod, and each of a further plurality of rods is secured adjacent one end thereof to said lateral projection o said bracket and extends slidably at the opposite end thereof into the bore in one of said tubular rods.

11. In a plastic bag making machine of the type defined in claim 7, wherein a portion of said cylinder at one end thereof is releasably secured in said opening in said lateral projection, and said lateral projection has therethrough a slot which opens at one end on said opening in said lateral projection and at its opposite end at the exterior of said lateral projection, whereby when said cylinder is released relative to said bracket the cylinder may be slid laterally out of said slot thereby removing also from said bracket the pressure plate, slitting blade and punch which are mounted on said piston rod.

12. In a plastic bag making machine of the type defined in claim 7, guide means interposed between said bracket and said pressure plate and operative to guide said pressure plate for reciprocation in a predetermined path upon reciprocation of said piston rod.

* * * * *